US007905753B2

(12) United States Patent
Siev et al.

(10) Patent No.: US 7,905,753 B2
(45) Date of Patent: Mar. 15, 2011

(54) COUPLER CONNECTOR

(75) Inventors: Virak Siev, Pointe-Claire (CA); Francois Beauregard, La Prairie (CA)

(73) Assignee: Belden CDT (Canada) Inc., Saint-Laurent (CA)

( * ) Notice: Subject to any disclaimer, the term of this patent is extended or adjusted under 35 U.S.C. 154(b) by 0 days.

(21) Appl. No.: 12/644,905

(22) Filed: Dec. 22, 2009

(65) Prior Publication Data

US 2010/0159752 A1 Jun. 24, 2010

Related U.S. Application Data

(60) Provisional application No. 61/139,786, filed on Dec. 22, 2008.

(30) Foreign Application Priority Data

Dec. 22, 2008 (CA) ..... 2647704

(51) Int. Cl.
*H01R 24/00* (2006.01)

(52) U.S. Cl. ..... 439/638; 439/676; 439/941; 439/67

(58) Field of Classification Search ..... 439/638, 439/676, 941, 67, 77, 495, 496
See application file for complete search history.

(56) References Cited

U.S. PATENT DOCUMENTS

| | | | | |
|---|---|---|---|---|
| 4,379,609 | A * | 4/1983 | Hardesty | 439/344 |
| 4,438,998 | A * | 3/1984 | Myers | 439/638 |
| 4,460,234 | A * | 7/1984 | Bogese | 439/557 |
| 4,593,966 | A * | 6/1986 | Meyer | 439/595 |
| 4,895,532 | A * | 1/1990 | Bogese, II | 439/507 |
| 6,146,207 | A * | 11/2000 | Mulot | 439/638 |
| 7,320,624 | B2 * | 1/2008 | Hashim et al. | 439/676 |
| 7,338,327 | B2 * | 3/2008 | Sticker et al. | 439/638 |
| 7,341,493 | B2 * | 3/2008 | Pepe et al. | 439/676 |
| 7,377,819 | B1 * | 5/2008 | Cooper et al. | 439/676 |
| 7,442,054 | B2 | 10/2008 | Lemke et al. | |

FOREIGN PATENT DOCUMENTS

| | | | |
|---|---|---|---|
| CA | 2291373 | A1 | 6/2000 |
| CA | 2325957 | A1 | 5/2001 |
| CA | 2464834 | A1 | 10/2005 |
| CA | 2549918 | A1 | 8/2007 |

* cited by examiner

*Primary Examiner* — Gary F. Paumen
(74) *Attorney, Agent, or Firm* — Goudreau Gage Dubuc; Hugh Mansfield

(57) ABSTRACT

A coupler connector and cross talk reducing network for coupling a first cable and a second cable in electrically conducting relation to each other, the first cable and the second cable respectively terminated by a first modular plug and a second modular plug each comprising respectively a first plurality of contact terminals and a second plurality of contact terminals.

18 Claims, 16 Drawing Sheets

180° Rotation (from center point)

a1 → a3
a2 → d2
b1 → c1
d1 → d3

COUPLER CONNECTOR

CROSS REFERENCE TO RELATED APPLICATIONS

This application claims benefit, under 35 U.S.C. §119(e), of U.S. provisional application Ser. No. 61/139,786, filed on Dec. 22, 2008. All documents above are incorporated herein in their entirety by reference.

FIELD OF THE INVENTION

The present invention relates to a coupler connector. In particular, the present invention relates to coupler connector for interconnecting cables comprising twisted pair conductors.

BACKGROUND OF THE INVENTION

In order to enable inter- or cross-connection between telecommunications equipment, telecommunications connections often use patch panels to which a plurality of jacks may be mounted to allow rapid connection and disconnection between two jacks in the same patch panel or in adjacent patch panels. Electrical cables terminated by plug-type connectors are typically inserted into the jacks and it is sometimes desirable to provide electrical coupling connectors that enable two plugs, and accordingly two cables, to be connected in electrically conducting relation to one another. For this purpose, such connectors comprise a housing with a pair of plug-receiving openings at each end thereof.

Such prior art connector designs however do not prove flexible as each one of a pair of cables is inserted into a given connector along a line of insertion which is at a fixed angle (e.g. collinear for a back-to-back configuration) relative to the other and it is therefore not possible to vary such an angle if desired to make cabling installation faster and more efficient. Also, the connector is typically limited to a specific length which cannot for example be adjusted if it is desired to increase the physical distance between coupled cables. Such designs also typically increase the complexity of cable termination in addition to providing limited functionality.

In addition, a major drawback of prior art designs is that they fail to meet signal transmission performance requirements, especially when high frequencies are involved. In particular, as new cable standards are introduced, more stringent specifications for alien crosstalk and system noise are featured. For instance, the latest Category 6a (or Augmented Category 6) standard defined in February 2008 provides performance at frequencies up to 550 MHz, or twice that of Category 6. It then becomes critical for telecommunications connections and connectors in particular to meet such enhanced performance standards, which conventional designs currently have difficulty achieving.

What is therefore needed, and an object of the present invention, is an improved connector, which allows for flexibility in the design of the connector as well as fast and efficient installation while reducing the complexity of termination and maximizing performance.

SUMMARY OF THE INVENTION

In order to address the above and other drawbacks, there is provided in accordance with the present invention a coupler connector for coupling a first cable and a second cable in electrically conducting relation to each other, the first cable and the second cable respectively terminated by a first modular plug and a second modular plug each comprising respectively a first plurality of contact terminals and a second plurality of contact terminals. The connector comprises a terminal assembly comprising a flexible printed circuit board, the flexible printed circuit board comprising a first plurality of contact elements provided at a first end of the flexible printed circuit board, each of the first plurality of contact elements electrically interconnected with a respective one of a second plurality of contact elements provided at a second end of the flexible printed circuit board, a first plug-receiving opening adapted to receive the first modular plug therein, wherein the first plurality of contact elements is disposed within the first plug-receiving opening such that when the first cable is inserted into the first opening, each of the first plurality of contact terminals comes into contact with a respective one of the first plurality of contact elements and a second plug-receiving opening adapted to receive the second modular plug therein, wherein the second plurality of contact elements is disposed within the second plug-receiving opening such that when the second cable is inserted into the second opening, each of the second plurality of contact terminals comes into contact with a respective one of the second plurality of contact elements.

There is also provided a cross talk reducing network for interconnecting a first cable and a second cable in electrically conducting relation to each other, the first cable and the second cable terminated respectively by a first modular plug and a second modular plug each comprising respectively a first plurality of contact terminals and a second plurality of contact terminals. The network comprises at least one cross talk reducing portion, each portion comprising a first pair of conductors and a second pair of conductors arranged side by side and in parallel, all of the conductors having substantially the same length, the first pair of conductors crossing over one another substantially at half way along the length and the second pair of conductors crossing over one another substantially half way between half way along the length and each end of the second pair of conductors, wherein the first pair of conductors and the second pair of conductors interconnect respective pairs of contact terminals of the first plug and the second plug.

Additionally, there is provided a method for reducing cross talk when interconnecting a first cable and a second cable, the first cable and the second cable terminated respectively by a first modular plug and a second modular plug each comprising respectively a first plurality of contact terminals and a second plurality of contact terminals. The method comprises interconnecting a first pair of the first plurality of contact terminals with a first pair of the second plurality of contact terminals using a pair of conductors and interconnecting a second pair of the first plurality of contact terminals with a second pair of the second plurality of contact terminals using a second pair of conductors, the first pair of conductors and the second pair of conductors arranged side by side and in parallel, all of the conductors having substantially the same length, and crossing the first pair of conductors over one another substantially at half way along the length and crossing the second pair of conductors over one another substantially half way between half way along the length and each end of the second pair of conductors.

Also, there is provided a coupler connector for coupling a first cable and a second cable in electrically conducting relation to each other, the first cable and the second cable terminated respectively by a first modular plug and a second modular plug each comprising respectively a first plurality of contact terminals and second plurality of contact terminals. The balanced connector comprises a first plug-receiving receptacle adapted to receive the first modular plug therein and a second plug-receiving receptacle adapted to receive the second modular plug therein, and a terminal assembly comprising a first plurality of contact elements disposed in the first plug receiving receptacle, a second plurality of contact elements disposed in the second plug receiving receptacle and a flexible printed circuit board comprising a plurality of conductive traces, the traces interconnecting respective ones of the first plurality of contact elements and the second plurality of contact elements. When the first cable is inserted into the first receptacle each of the first plurality of contact terminals comes into contact with a respective one of the first plurality of contact elements and when the second cable is inserted into the second opening, each of the second plurality of contact terminals comes into contact with a respective one of the second plurality of contact elements.

DESCRIPTION OF ILLUSTRATIVE EMBODIMENTS

The present invention is illustrated in further details by the following non-limiting examples.

Figure 1:
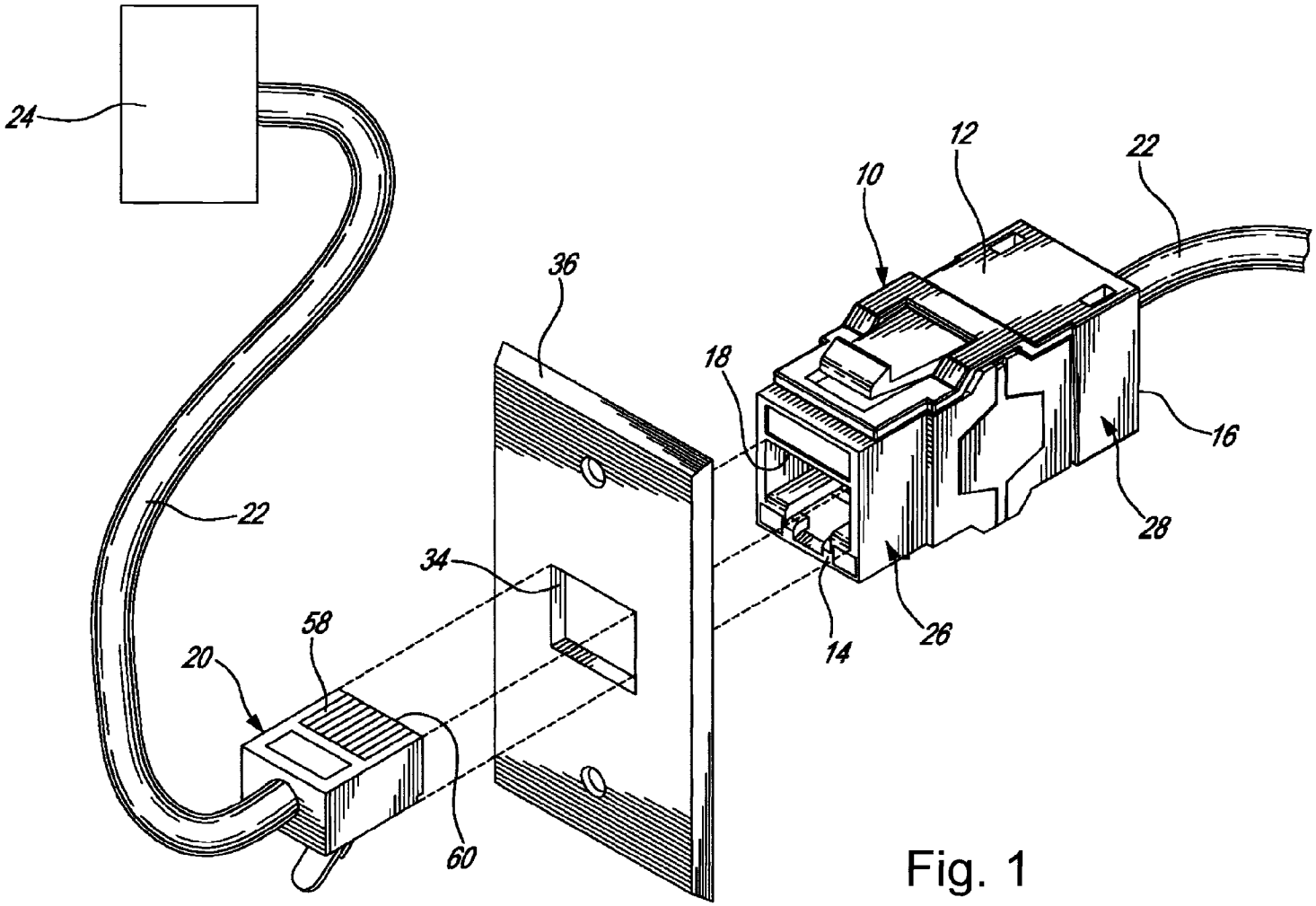
FIG. 1 is a perspective view of a coupler connector in accordance with an illustrative embodiment of the present invention.

Referring now to FIG. 1, a coupler connector, generally referred to using the reference numeral 10, will now be described. The coupler connector 10 comprises a housing 12 having a front end 14 and a rear end 16. A receptacle socket or plug-receiving opening 18 is provided at each one of the front and rear ends 14 and 16, each plug-receiving opening 18 being disposed in an opposed mirror-image configuration for receiving therein a mating modular plug 20 (e.g. of the RJ-45 standard, not shown) terminating a communications cable 22 which, at an opposite end, may for example be terminated by networking equipment 24 such as switches, hubs, routers, repeaters and the like (all not shown). The cables as in 22 may illustratively comprise the same number of twisted pairs of conductors (not shown). Insertion of the plugs as in 20 into the respective plug receiving openings as in 18 of the connector 10 thus enables for two (2) cables as in 22 to be coupled in electrically conducting relation to each other.

Figure 2:
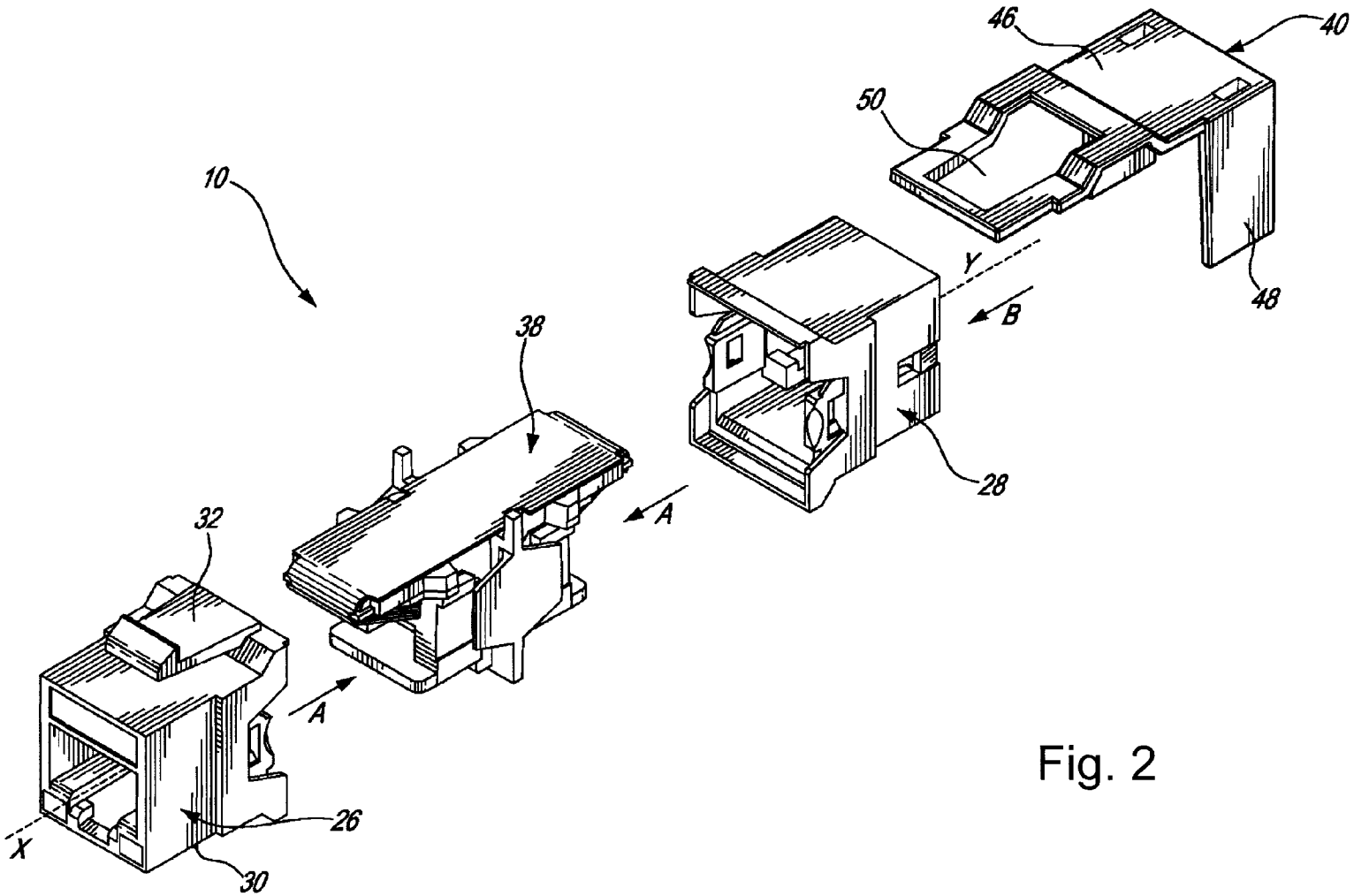
FIG. 2 is an exploded view of the coupler connector of FIG. 1.

Referring now to FIG. 2 in addition to FIG. 1, the housing 12 of the connector 10 illustratively comprises two substantially identical housing members 26 and 28 with at least one of the housing members (illustratively housing member 26) having moulded or otherwise formed on a bottom outer surface thereof a tab 30 and on an upper surface thereof a resilient cantilever latch member 32, which enable the connector 10 to be securely mounted and retained within a connector-receiving aperture 34 of a patch panel 36, thus enabling interconnection between the various telecommunications equipment as in 24. The housing members 26 and 28 are illustratively manufactured from a suitable rigid non-conducting material such as plastic and are snap-fitted to a terminal assembly 38 along the direction of arrows A, as will be detailed further herein below. An outer housing member 40 is then illustratively slid over the mated housing members 26 and 28 along the direction of arrow B to complete assembly of the connector 10.

Figure 3:
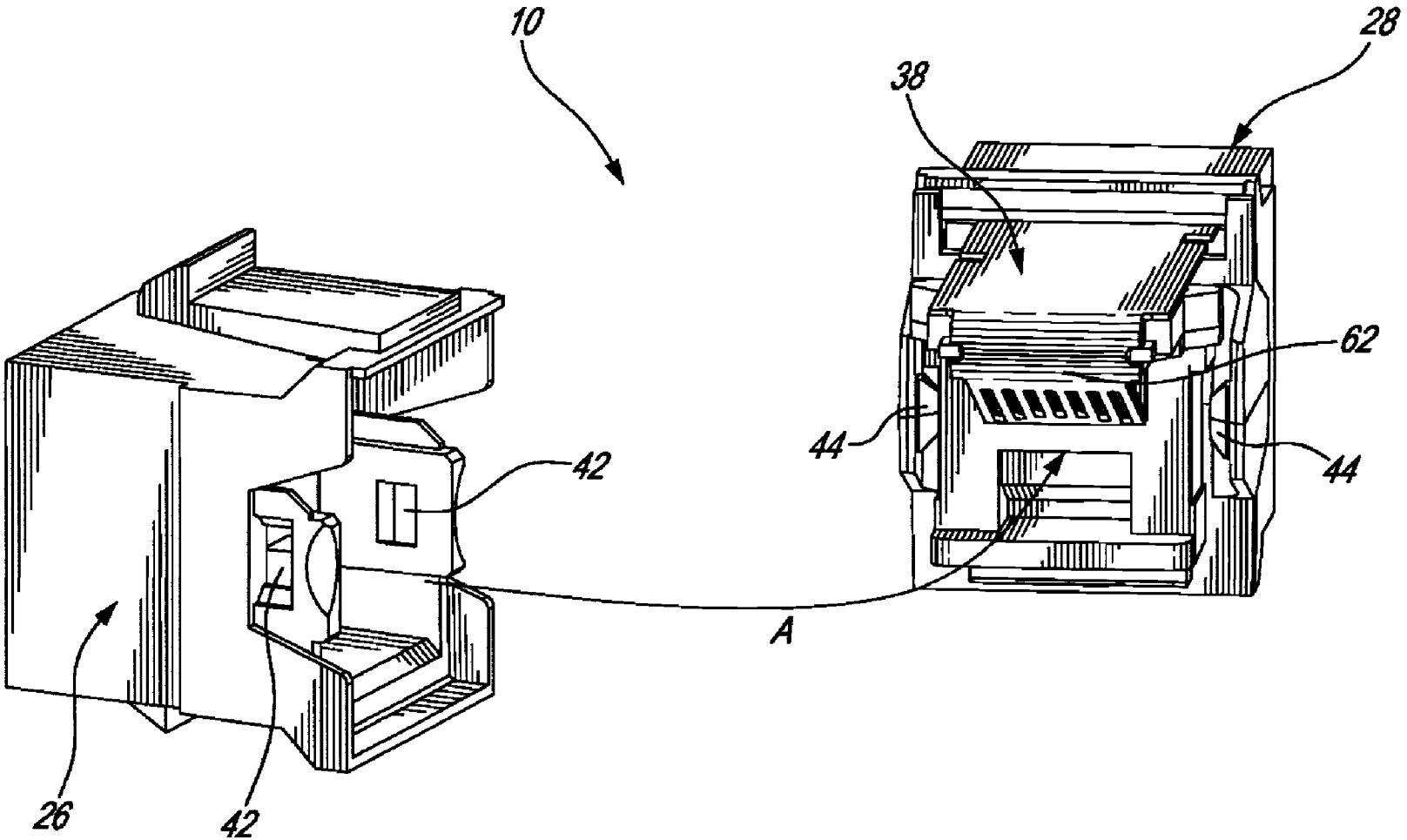
FIG. 3 is a perspective view of a first housing member being mounted to a mated terminal assembly and second housing member of a coupler connector in accordance with an illustrative embodiment of the present invention.

Referring now to FIG. 3, in order to mate the housing members 26, 28 to the terminal assembly 38, each housing member 26, 28 is provided on opposite sides thereof with a pair of tab receiving indentations as in 42 adapted to receive therein a pair of raised tabs as in 44 provided on opposite internal surfaces of the terminal assembly 38. As both housing members 26 and 28 are to be mated over the terminal assembly 38, the latter is illustratively provided with a first pair of tabs as in 44 adjacent a front face (not shown) of the terminal assembly 38 for engaging the indentations as in 42 of housing member 26 and a second pair of tabs as in 44 adjacent a rear face (not shown) of the terminal assembly 38 for mating with the indentations as in 42 of housing member 28. In this manner, the housing members 26, 28 are securely held in place over the terminal assembly 38 to which they are mounted, with the terminal assembly 38 being illustratively fully covered by the housing members 26, 28 (as illustrated in FIG. 1) so as to provide protection to the terminals (not shown).

Figure 4:
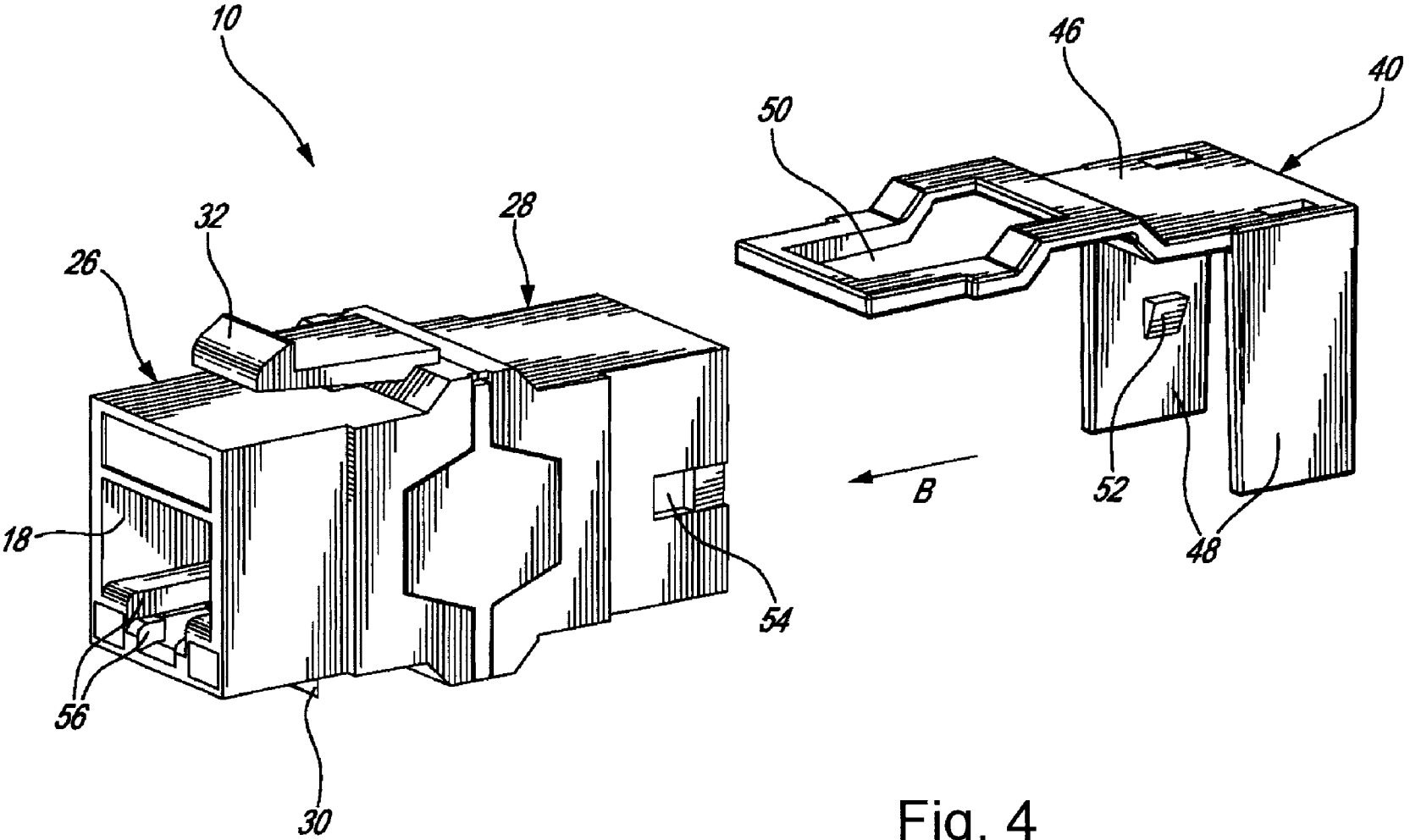
FIG. 4 is a perspective view of an outer housing being mounted to the mated first and second housing members of a coupler connector in accordance with an illustrative embodiment of the present invention.

Referring now to FIG. 4, the outer housing member 40 illustratively comprises an upper wall 46 and two side walls as in 48 extending downwardly from opposite edges of the upper wall 46 at substantially right angles. The outer housing 40 is adapted to be slidably mounted over the mated housing members 26, 28 and terminal assembly (reference 38 in FIG. 2) along the direction of arrow B for better retaining the housing members 26 and 28 in place relative to one another. For this purpose, the upper wall 46 is illustratively shaped and sized so as to conform to the shape of the upper outer surface of the mated housing members 26 and 28 (see FIG. 1) such that, when the outer housing 40 is mounted over the assembled housing members 26 and 28, the upper wall 46 snugly fits on the upper outer surface of the assembled housing members 26 and 28 while the side walls as in 48 abut against the side surfaces of housing member 28. The upper wall 46 also illustratively has formed therein adjacent a front end thereof a latch receiving aperture 50, which is adapted to accommodate the latch member 32 of housing member 26, thus easing access thereto for insertion of the connector 10 into the connector-receiving aperture (reference 34 in FIG. 1) of the patch panel (reference 36 in FIG. 1), as discussed herein above once the connector 10 has been fully assembled. In order to ensure that the outer housing member 40 is securely mounted to the mated housing members 26 and 28, each side wall 48 is further provided with a raised tab 52, which is adapted to be received in a corresponding slot 54 formed adjacent the rear face of housing member 28 on opposite sides thereof.

Still referring to FIG. 4, although the connector 10 has been shown as a keystone type connector, the snap-in housing design discussed herein above equally applies to other types of connectors, such as MDVO and industrial type connectors (not shown), which may then be snap-fitted over the terminal assembly (reference 38 in FIG. 2) along the direction of arrows A (FIG. 3) in a manner similar to the one discussed herein above.

Still referring to FIG. 4, a smart latch lock feature may be provided to avoid removal of the connector 10 from the patch panel (reference 36 in FIG. 1) when a cable (reference 22 in FIG. 1) has been inserted into the plug-receiving opening 18 disposed on the rear end (reference 16 in FIG. 1) of the connector 10. In particular, when downward pressure is exerted on the cable 22 and associated plug (not shown), the extremity of the latch receiving aperture 50 presses against the latch member 32. In this manner, the pressure exerted on the latch member 32 locks the cable 22 in place and prevents inadvertent disengagement thereof from the connector 10.

Referring back to FIG. 1 and FIG. 3 in addition to FIG. 4, the plug receiving opening 18 of the housing member 26, whose description will suffice as a description of the housing member 28, comprises a bottom wall (not shown) along which a plurality of channels or keyway slots as in 56 extend rearwardly from the front end 14 of the connector 10. These channels as in 56 form a latch groove, which enables mating of the appropriately keyed modular plug 20 with the plug receiving opening 18, the plug 20 having a plurality (illustratively eight(8)) of spaced terminal contacts 58 exposed along a forward face 60 of the plug 20. The contacts as in 58 terminate individual conductor wires (not shown) of the cable 22 secured to the plug 20 and are brought into contact with complementary contact elements (not shown) provided in the connector 10, thereby providing a conductive path between the plug 20 and the connector 10.

Figure 5:
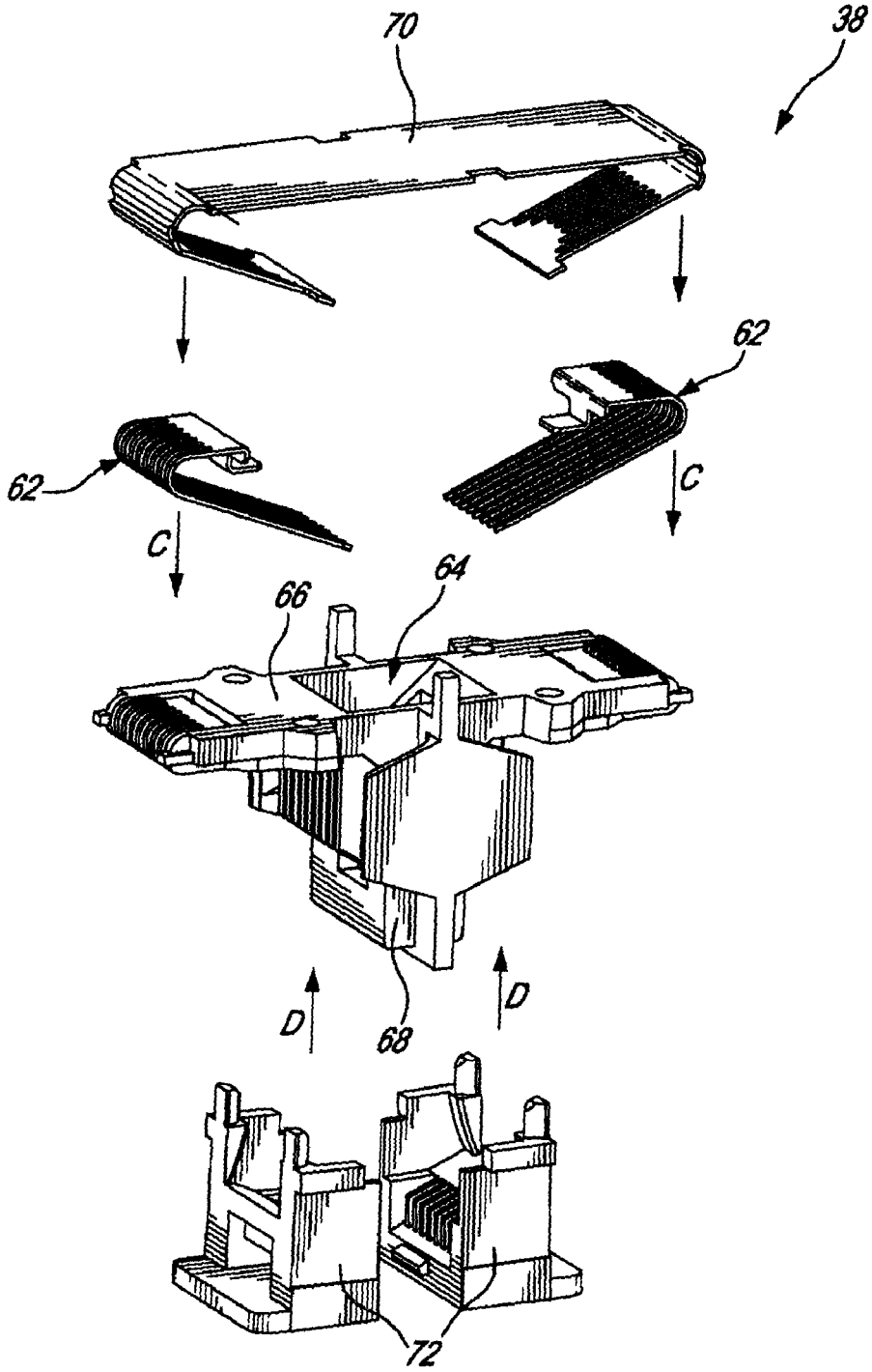
FIG. 5 is an exploded view of a terminal assembly of a coupler connector in accordance with an illustrative embodiment of the present invention.

Referring now to FIG. 5, each one of a pair of spring elements as in 62, which are enclosed in a corresponding housing member (references 26, 28 in FIG. 4) when the latter is assembled to the terminal assembly 38, is illustratively secured to a T-shaped rigid terminal support structure 64, for example manufactured of non-conductive material such as plastic. The support 64 comprises an elongate and substantially horizontal support member 66 having a substantially vertical support member 68 extending downwardly therefrom at a substantially right angle. A tine (reference 74 in FIG. 6) of a spring element 62 illustratively presses against contact elements (not shown) of a flexible printed circuit board (flex PCB) 70. As known in the art, using a photo mask and an etching process, the PCB 70 can be fabricated to include a plurality of non-intersecting conductive paths (traces) between various points on or between either surface (upper and lower) of the PCB 70. Once a spring element 62 has been slidably mounted to the support 64, the spring element 62 is further protected by a retainer 72, which may be removably attached to the support 64 over the spring element 62, as will be described in further detail herein below. In this manner, there is provided a countering force tending to ensure a reliable contact between contacts of the PCB 70 and the contacts (reference 58 in FIG. 1) of a mating cable plug (reference 20 in FIG. 1) when the plug 20 is inserted into a plug-receiving aperture (reference 18 in FIG. 1) of the connector (reference 10 in FIG. 1).

Figure 6:
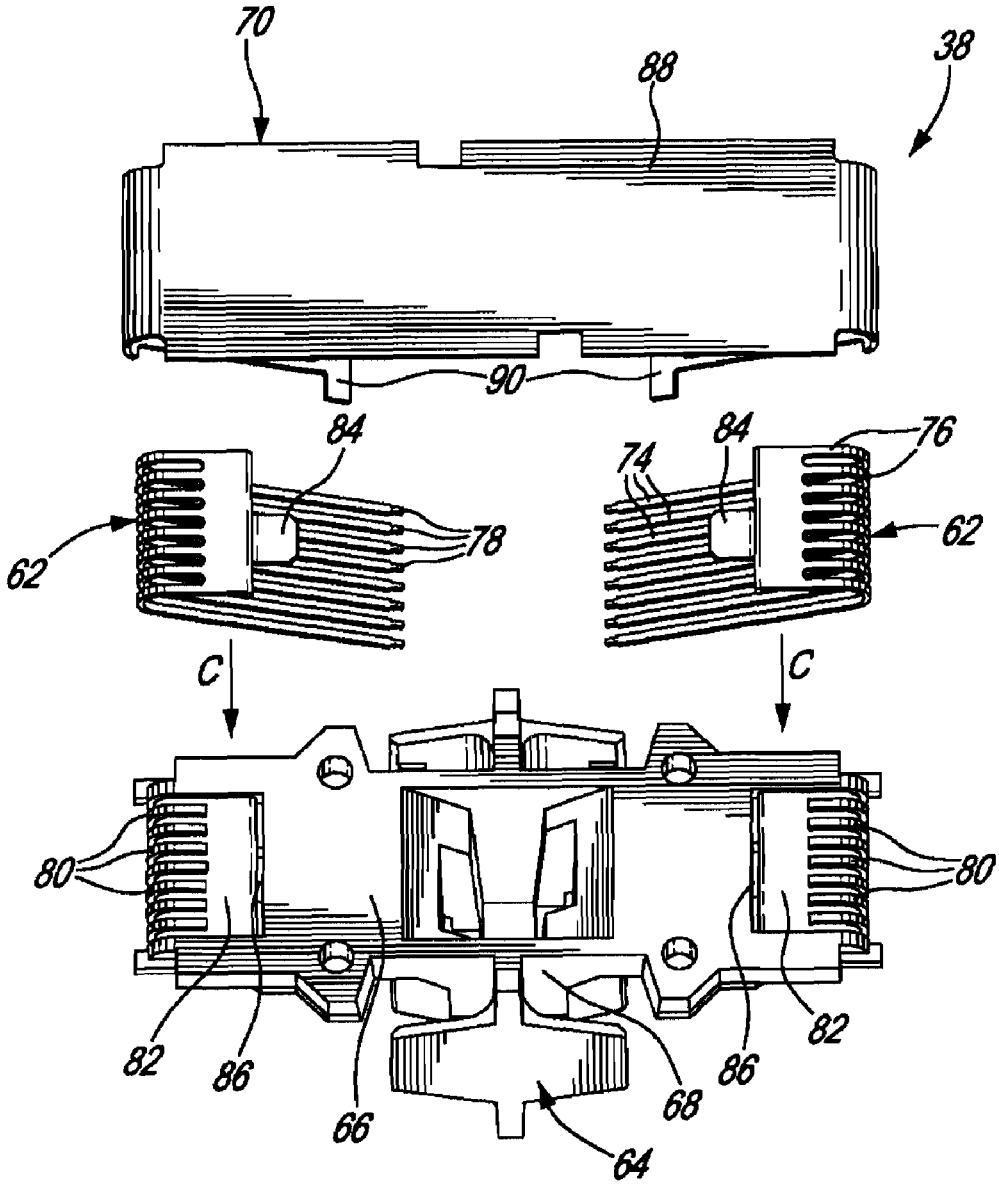
FIG. 6 is a top perspective view of the terminal assembly of FIG. 5.

Referring now to FIG. 6, the spring elements as in 62 are illustratively bent to form tines as in 74 extending obliquely from intermediate portions as in 76 and having free ends as in 78. When the spring elements as in 62 are slid over the support 64 along the direction of arrows C, each intermediate portion 76 of a spring element 62 sits between an adjacent pair of alignment channels as in 80 extending along an outer edge of a terminal alignment plate 82, a pair of such terminal alignment plates as in 82 being provided at opposite ends of the horizontal support member 66. The tines as in 74 and the free end portions as in 78 project downwardly away from the terminal alignment plates as in 82 at an oblique angle thereto with the free end portions as in 78 of the spring elements as in 62 abutting against opposite sides of the vertical support member 68, as will be further described herein below. In order to better secure the spring elements as in 62 to the support 64, each spring element 62 is further illustratively provided with a locking tab 84 adapted to engage a corresponding slot 86 on an edge of each terminal alignment plate 82. Once the spring elements as in 62 are fitted over the horizontal support member 66, each tab 84 is then inserted into the slot 86 in a conventional manner to lock the spring elements as in 62 in place.

Still referring to FIG. 6, the flex PCB 70 is illustratively comprised of a shield feature (not shown) for protecting the spring elements as in 62 and is sized and shaped to conform to the latter. For this purpose, the flex PCB 70 comprises a central portion 88 and a pair of end portions as in 90 extending away from a lower surface of the central portion 88 at an oblique angle, which is substantially the same as the bent angle of the spring elements as in 62. Each end portion 90 of the flex PCB 70, and accordingly the shield feature provided therewith, thus covers the plurality of tines as in 74 of a spring element 62 to provide a conductive path between various points thereon or between either surface thereof, as discussed herein above.

Figure 7:
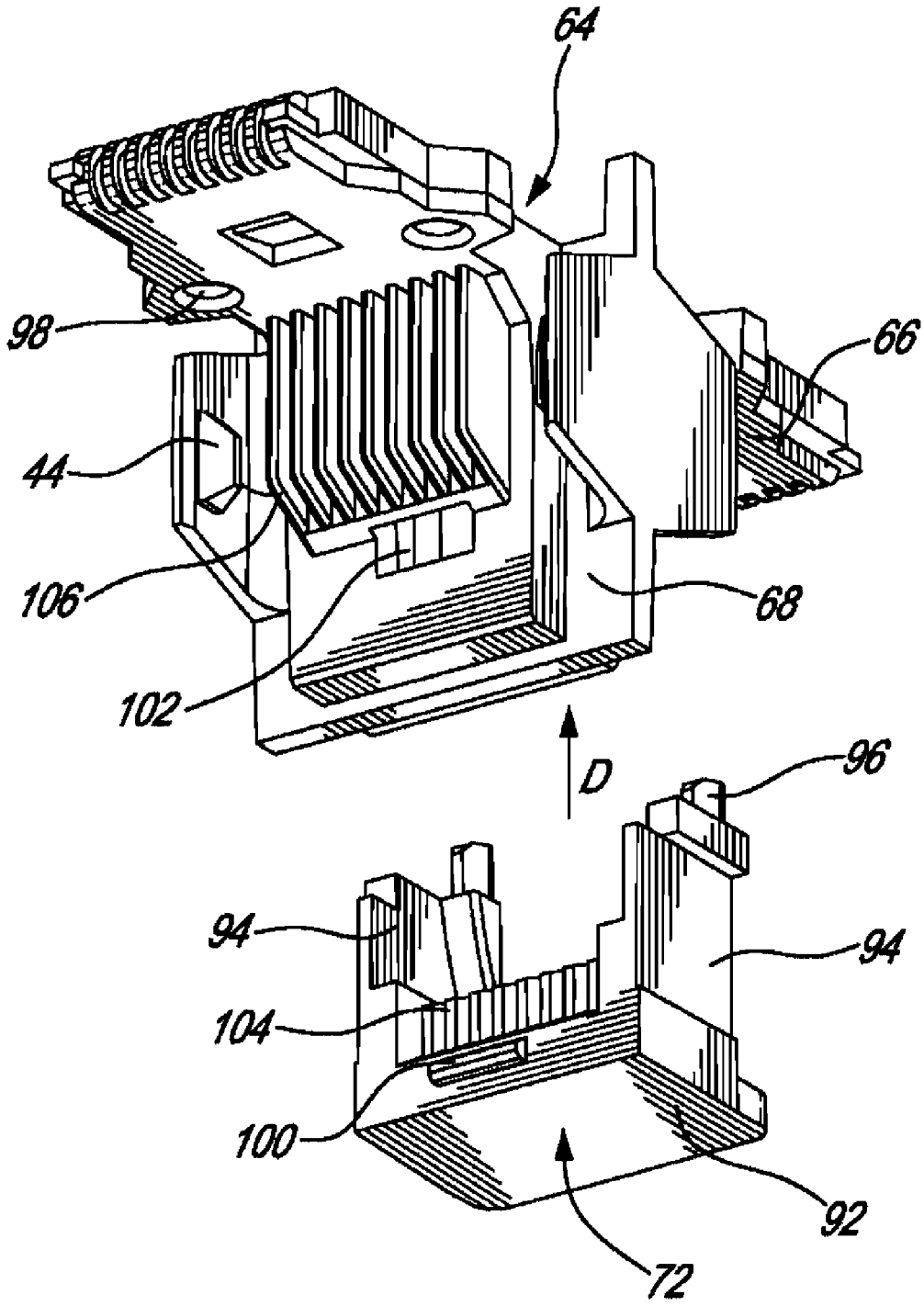
FIG. 7 is a bottom perspective view of the terminal assembly of FIG. 5 with one retainer being mounted thereto.
Figure 8A:
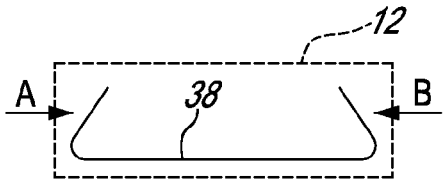
FIG. 8 provides a plan view of alternative embodiments of interconnectors and the respective bends introduced into the flexible printed circuit board.
Figure 8B:
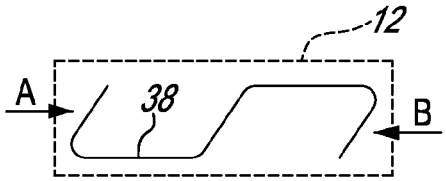
Figure 8C:
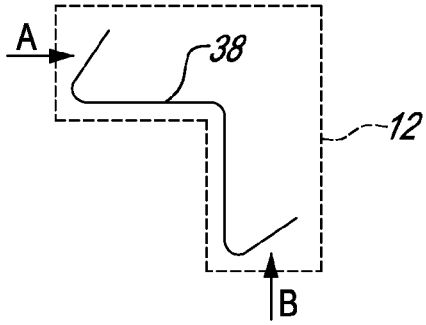
Figure 8D:
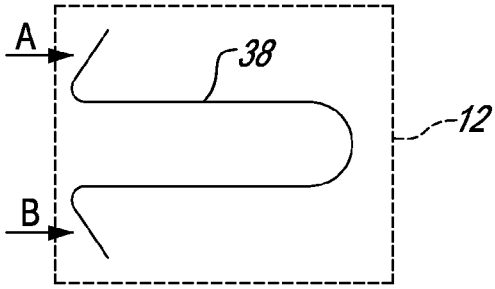
Figure 8E:
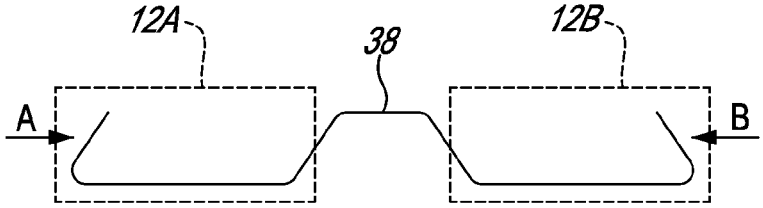

Referring now to FIG. 7, the retainers as in 72 are illustratively mounted to the support 64 to retain the spring elements as in 62 against the support 64 and limit the range of movement of the support 64. It should be noted that, for illustration purposes, only the retainer 72, which is adapted to be mounted to the rear side of the vertical member 68 along the direction of arrow D and subsequently covered by the outer housing member (reference 40 in FIG. 4) is shown in FIG. 7. Each retainer 72 comprises a base member 92 having edges (not shown) from which a pair of side walls as in 94 extend upwardly at substantially right angles. A post 96 extends from an upper edge of each one of the side walls as in 94 and is adapted for engagement with a corresponding post receiving bore 98 moulded or otherwise machined in the horizontal support member 66. A projecting member 100 is further provided on an outer surface of the base 92 and is adapted to be received in a corresponding slot 102 formed on the vertical member 68. This ensures that, once mounted, the retainer 72 is firmly secured to the support 64.

Still referring to FIG. 7, a comb-like structure 104 comprising a plurality of raised tongues (not shown) is mounted to the base 92 of each retainer 72 between the side walls as in 94 and has teeth (not shown) which are adapted to mate with the teeth (not shown) of a corresponding one of a pair of comb-like structures as in 106 mounted to opposite sides of the vertical member 68. Each comb-like structure 106 is adapted to receive therein the free end portions (reference 78 in FIG. 6) of the spring elements (reference 62 in FIG. 6). In particular, once the spring elements as in 62 have been fitted over the horizontal member 66 of the support 64, the free end portions as in 78 abut against a corresponding side of the vertical member 68 and each free end portion 78 is retained between an adjacent pair of teeth of a comb-like structure 106. The retainers as in 72 are then mounted to the vertical member 68 of the support 64 along the direction of arrow D such that the teeth of the comb-like structure 104 engage corresponding teeth of the comb-like structure 106, thus protecting the free end portions as in 78 and the tines (reference 74 in FIG. 6) of the spring elements as in 62 as well as limiting travel thereof.

Referring back to FIG. 6 in addition to FIG. 7 and in accordance with an alternative embodiment of the present invention, the flex PCB 70 may be used to link the free end portions as in 78 of both spring elements as in 62. In this case, the end portions as in 90 of the flex PCB 70 would be connected and the conductive traces would illustratively extend the length of the tines as in 74 to provide a conductive path between the free end portions as in 78 of both spring elements as in 62.

Although the present illustrative embodiment as described with reference to FIGS. 1 through 7 discloses a back-to-back connector, the ductile nature of the flexible printed circuit board 38 of the present invention allows for manipulation of the interconnection and therefore a variety of advantageous alternative illustrative embodiments. Referring to FIG. 8, embodiments (A) through (E), with appropriate modifications to the housings 12, the flexible printed circuit board 38, shown in an unbent back-to-back configuration in (A), may be bent in order to provide interconnection of modular plugs (B) reversed, (C) at right angles, or (D) side-by-side. Additionally, referring to (E) the length of the flexible printed circuit board 38 may be extended to flexibly interconnect housing parts $\mathbf{12}_A$ and $\mathbf{12}_B$, and therefore modular plugs (not shown), positioned at some distance from one another. Of note is that the arrows A and B indicate the direction of insertion of the modular plug into the housing 12.

Figure 9:
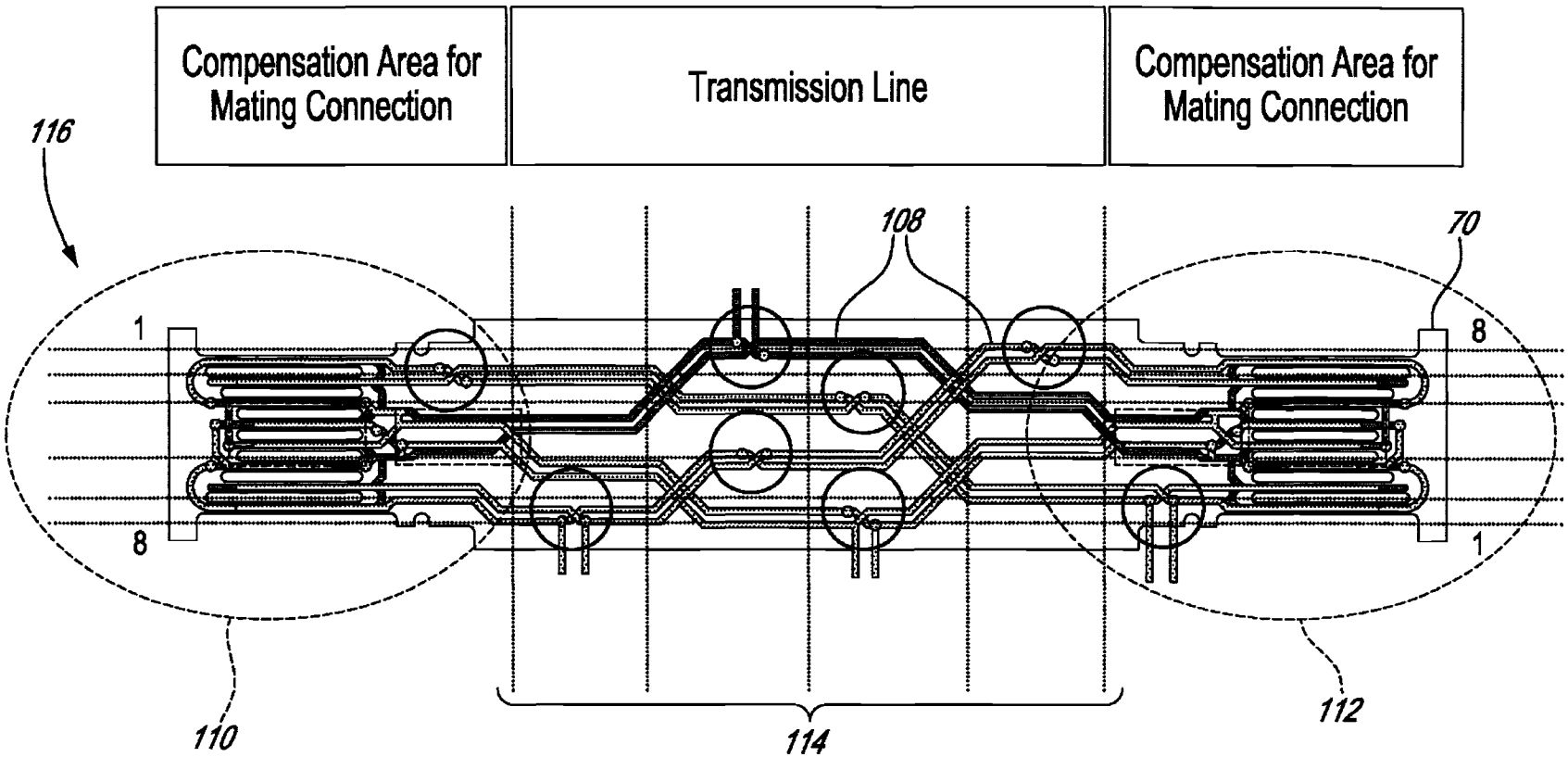
FIG. 9 is a schematic diagram of a compensating network of the coupler connector of FIG. 1.

Referring now to FIG. 9 in addition to FIG. 1 and FIG. 6, as the plug-receiving openings as in 18, and therefore the tines as in 74 positioned therewithin, are illustratively positioned in a back-to-back relationship due to the mirror-image configuration of the housing members 26, 28, each tine 74 extending within the plug-receiving opening 18 of the first housing member 26 is illustratively interconnected with a respective one of the tines as in 74 of the plug-receiving opening 18 of the second housing member 28. Moreover, the order of the tines as in 74 of the plug-receiving opening 18 of the first housing member 26 is illustratively reversed versus the order of the tines as in 74 of the plug-receiving opening 18 of the second housing member 28. It is then desirable to etch onto the surfaces (illustratively upper and lower, not shown) of the flex PCB 70 conductive traces as in 108 used to interconnect the tines as in 74 in such a manner that the traces as in 108 traverse from one end of the flex PCB 70 to the other and are reversed. In particular, the traces as in 108 are etched as two halves 110 and 112 (illustratively etched onto the upper and lower surfaces of the end portions as in 90 of the flex PCB 70) interconnected with a transmission line 114 (illustratively etched onto the upper and lower surface of the central portion 88), with the second half 112 being a replication of the first half 110.

Still referring to FIG. 9 in addition to FIG. 6, a compensating network 116 illustratively comprised of a series of selectively interconnected capacitive and/or inductive compensating elements (not shown) may be integrated into the connector (reference 10 in FIG. 1) to ensure that signal transfer at the interface between the plug (reference 20 in FIG. 1) and the connector 10 is improved. Indeed, in this illustrative embodiment, standards for the connector interface provide that when a plug 20 is inserted into a corresponding plug-receiving opening (reference 18 in FIG. 1), the four (4) twisted pairs (not shown) of the network cable 22 are separated into eight (8) single conductors (not shown) numbered 1 to 8 and connected to the eight (8) terminal contacts (reference 58 in FIG. 1) of the plug 20. Specifically, the standard pair arrangement provides for wires 4-5 comprising pair 1, wires 3-6 comprising pair 2, wires 1-2 comprising pair 3, and wires 7-8 comprising pair 4. Use of the compensating network 116 then counters the parasitic capacitances and reactances generated by insertion of the plug 20 into the plug-receiving opening 18 of the connector 10, thus significantly improving the overall performance thereof, especially at high frequencies, in terms of reduced crosstalk, reduced noise, etc.

Figure 10:
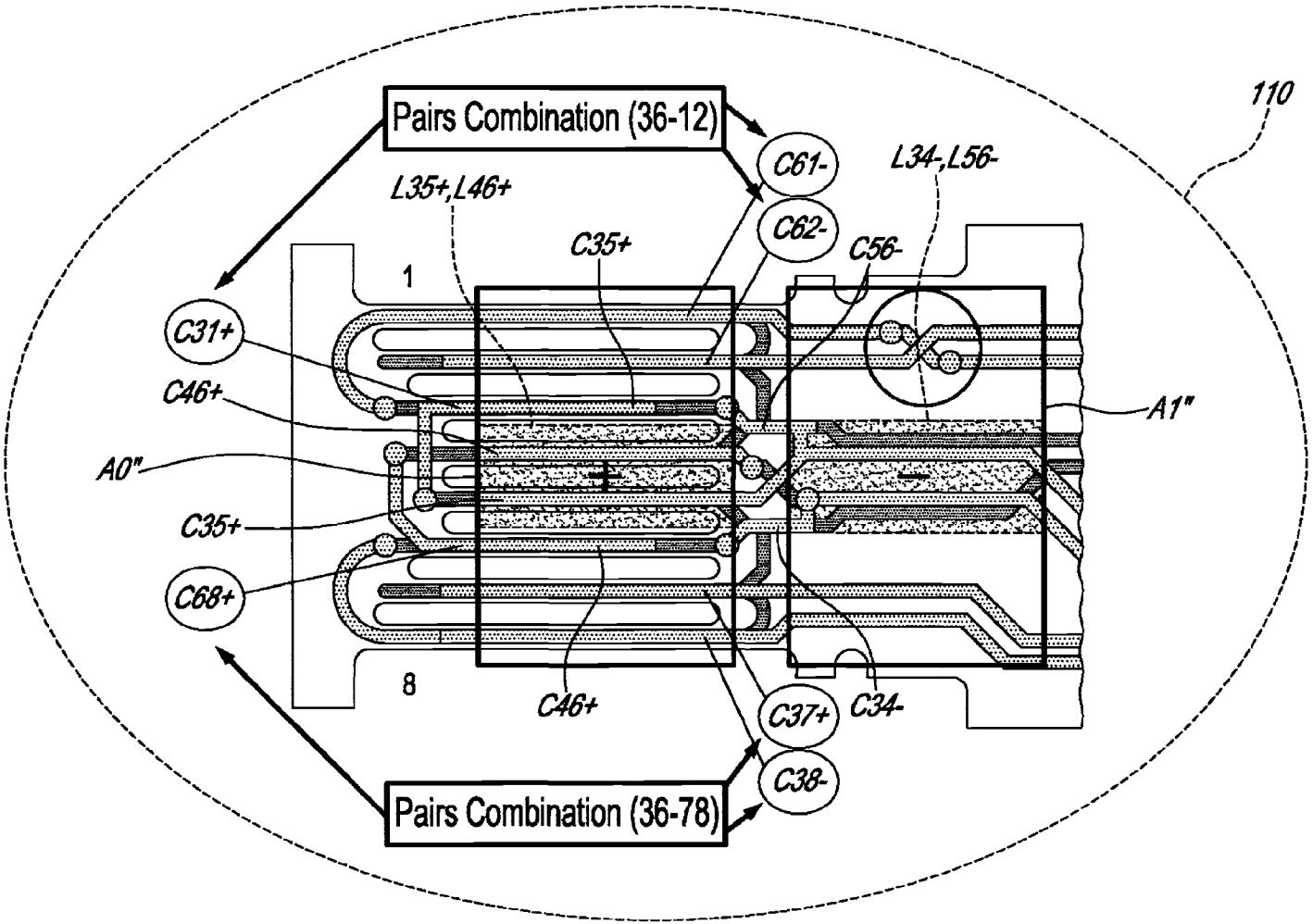
FIG. 10 is an exploded view of the compensating network of FIG. 8.
Figure 11:
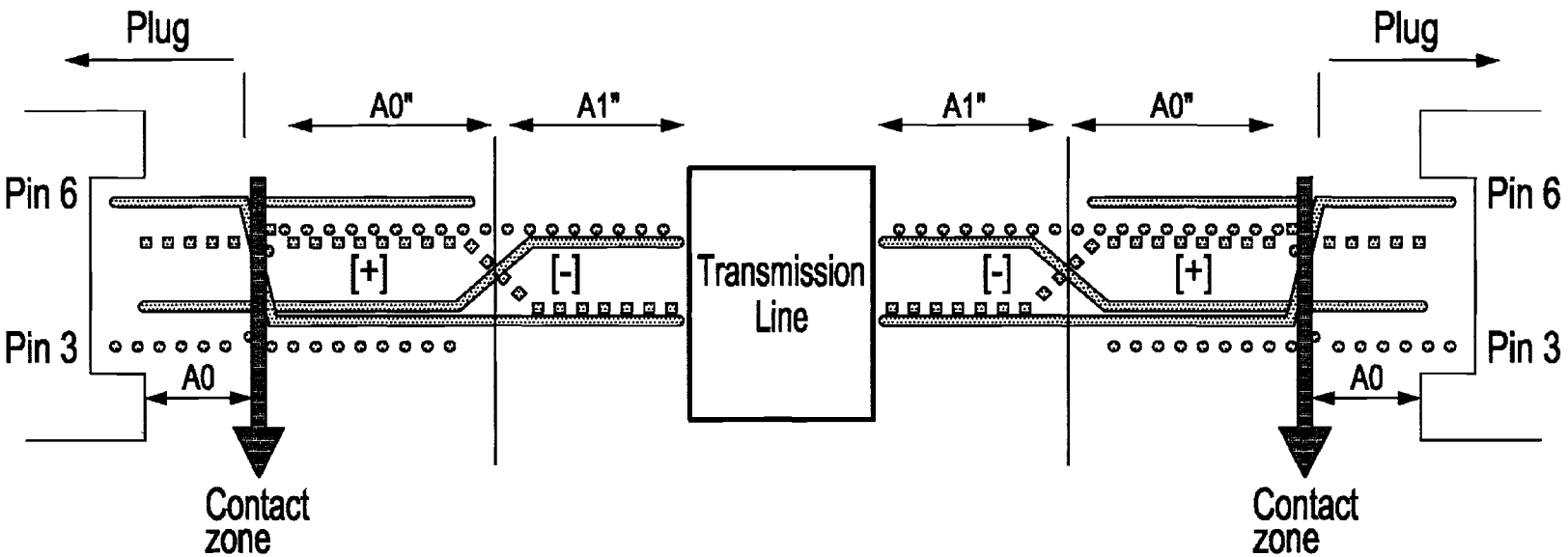
FIG. 11 is a schematic diagram of the path taken by a signal in a first conductor pair combination from one end of the coupler connector of FIG. 1 to the other.

Referring now to FIG. 10 and FIG. 11 in addition to FIG. 8, a first forward loop of compensation A0" for countering parasitic crosstalk at pair combination 1-2 (i.e. between wires 4-5 and 3-6) is introduced into the first half 110. The loop of compensation A0" illustratively has a phase opposite to that of the offending signal A0 from the plug (reference 20 in FIG. 1) and advantageously does not introduce any additional unwanted signal, unlike traditional compensation techniques. Moreover, the compensation is illustratively applied directly underneath the contact point (not shown) between the plug 20 and the connector (reference 10 in FIG. 1), thus reducing the amount of crosstalk (DNEXT) within the plug 20. A second reverse loop of compensation A1" having the same phase as the offending signal A0 in the plug 20 is further introduced.

Still referring to FIG. 10 and FIG. 11 in addition to FIG. 9, compensation is similarly introduced in region A0" for other pair combinations, such as pairs 2-3 (i.e. between wires 3-6 and 1-2) and pairs 2-4 (i.e. between wires 3-6 and 7-8), underneath the area where the plug 20 mates with the connector 10. Identical and symmetrical compensation (A1" and A0") is then applied for pair combinations of the second half 112. Accordingly, in following the path of the electrical signal from one end (i.e. the point where the plug 20 is inserted into the plug-receiving aperture, reference 18 in FIG. 1, of a housing member 26 or 28) to the other, the overall applied compensation can be represented as a series of successive compensation signals with varying polarity (as illustrated in FIG. 11), namely a positive signal (forward loop A0"), followed by a negative signal (reverse loop A1"), a negative signal (reverse loop A1"), and a positive signal (forward loop A0").

Figure 12A:
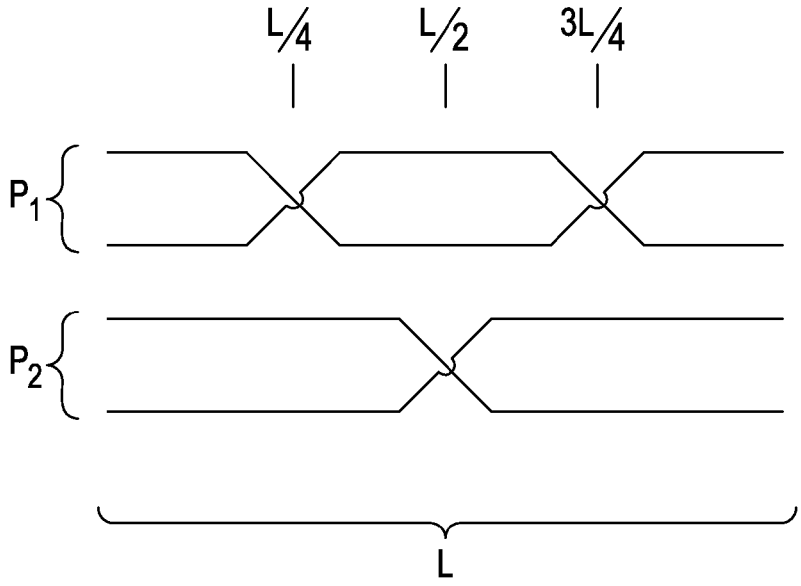
FIG. 12 is a diagram of a compensating conductor configuration in accordance with two alternative embodiments of the present invention.
Figure 12B:
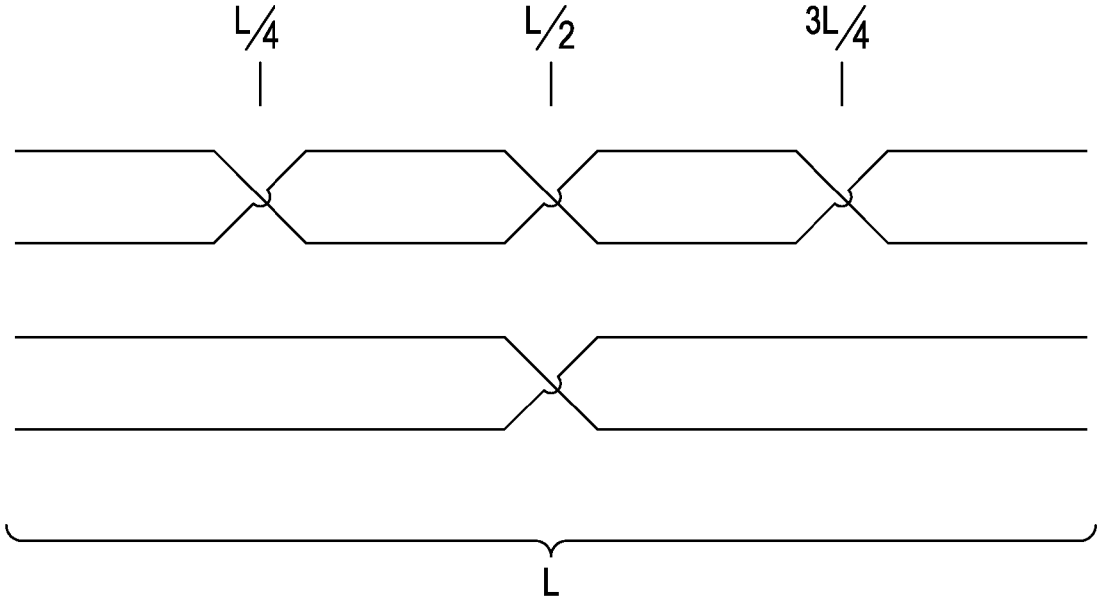

Referring now to FIG. 12, in order to provide an compensation for differential mode (DM) and common mode (CM) signals on pairs adjacent of conductors $P_1$ and $P_2$ arranged in parallel and all having a length L, for example as conductive traces on the surface of a circuit board, the conductors of the pairs cross over one another along their length. Referring to (A) in FIG. 12, in a first illustrative embodiment the cross over of the conductors $P_1$ are located at L/4 and 3L/4 whereas the cross over in $P_2$ is located at L/2. Referring to (B) in FIG. 12, in a second illustrative embodiment the cross over of the conductors $P_1$ are located at L/4, L/2 and 3L/4 whereas the cross over in $P_2$ is again located at L/2.

Still referring to FIG. 12, in a printed circuit board of the present invention the crossovers are typically implemented by piercing the circuit board and continuing one of the traces on the opposite side of the circuit board. Additionally, the above formulas A and/or B may be repeated in interconnected sections, for example by interconnecting $P_1$ and $P_2$ of a first section respectively with $P_1$ and $P_2$ of a second section.

Figure 13A:
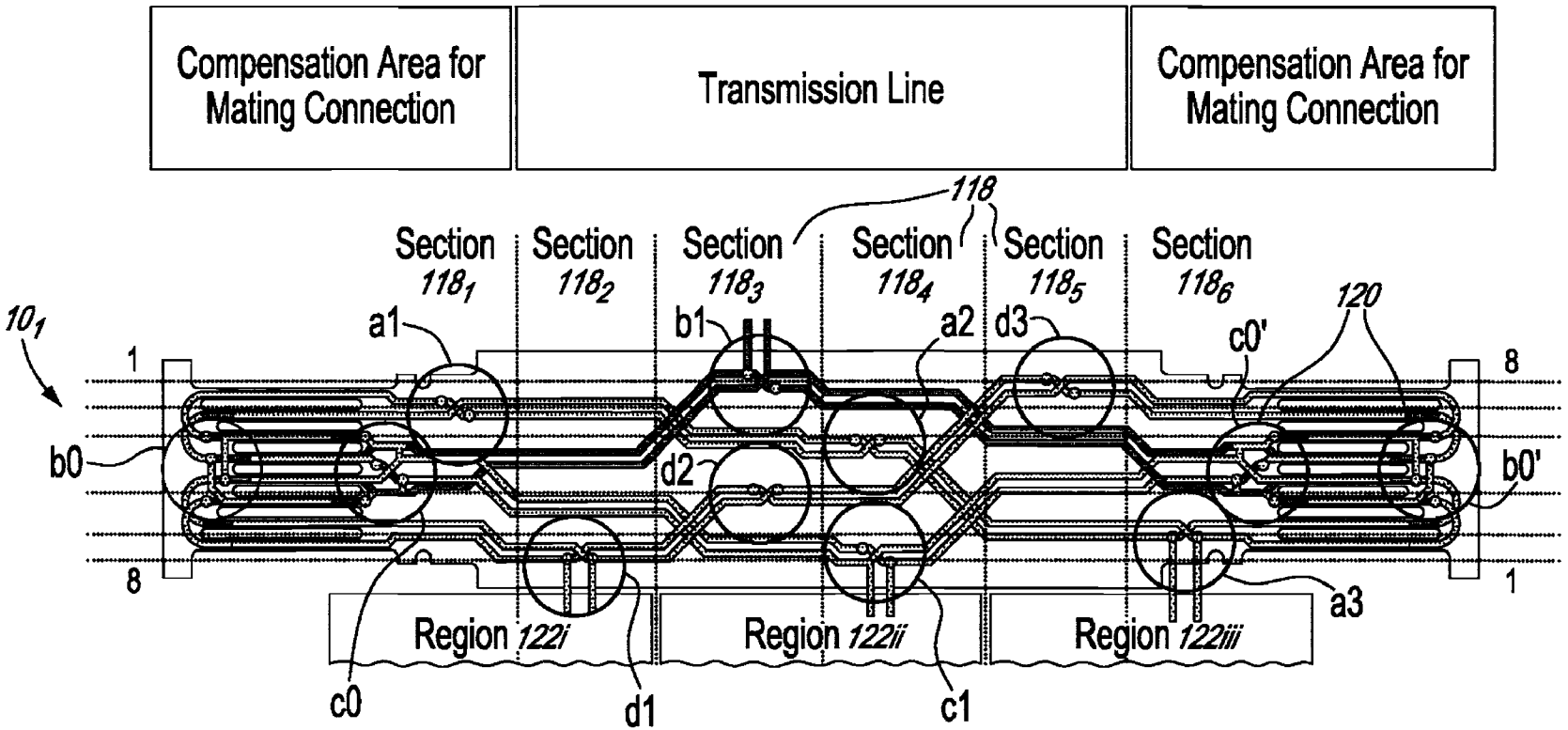
FIGS. 13A and 13B together provide a schematic diagram of a transmission line network design for the coupler connector of FIG. 1.
Figure 13B:
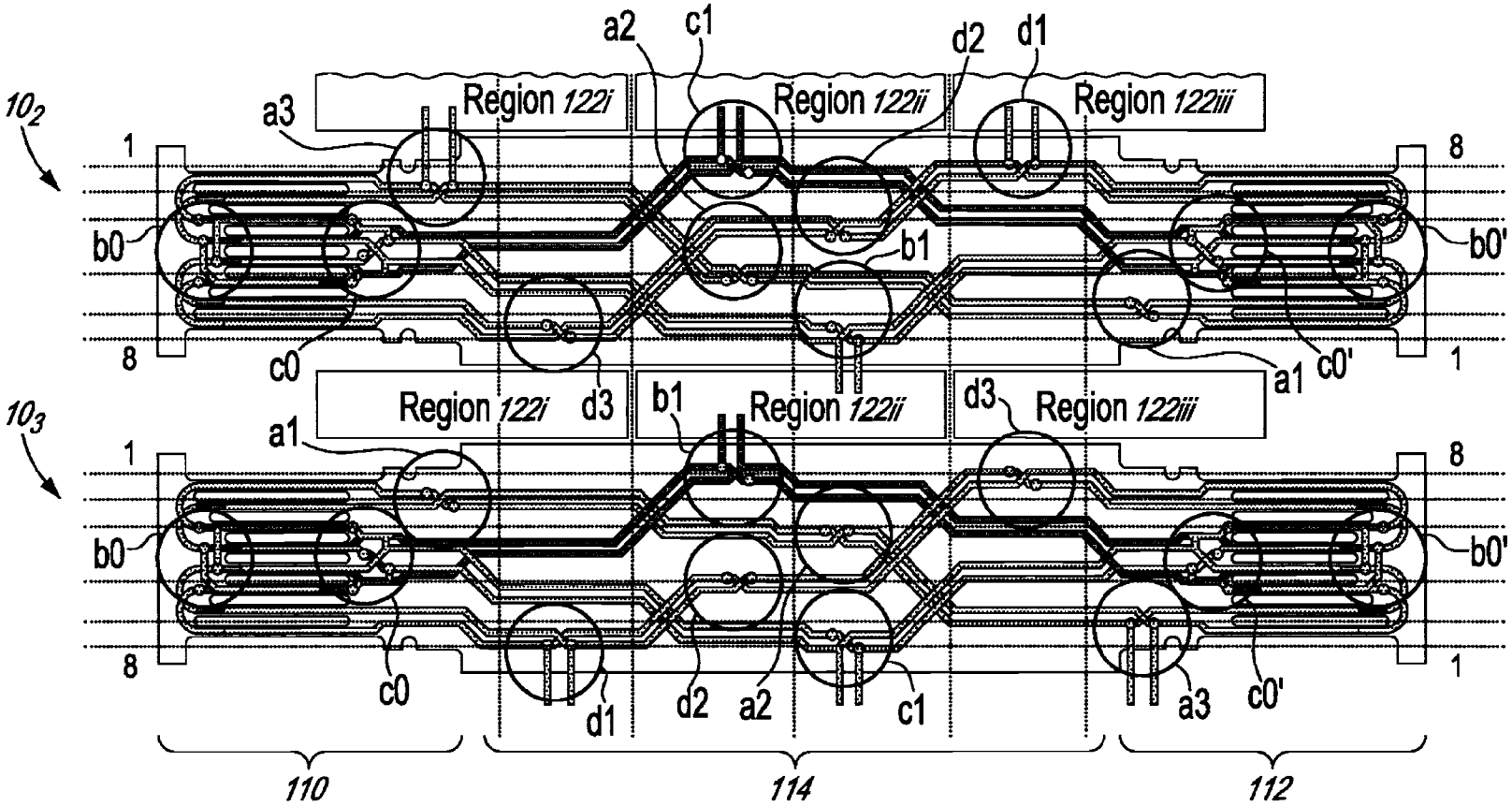

Referring now to FIGS. 13A and 13B, the transmission line 114 is illustratively modeled as a plurality (e.g. four (4)) of trace sections as in 118 with a minimum of 2n+1 reversal points as in 120 (i.e. the points where individual traces, reference 108 in FIG. 9, of a pair—or alternatively trace pairs—cross). The number n of reversal points as in 120 is illustratively a positive integer starting from 0 and the number of reversal points is accordingly odd. For example, for a connector (reference 10 in FIG. 1) comprising four (4) conductor pairs (not shown), pair 3 (i.e. wires 1-2) illustratively comprises three (3) reversal points as in 120, namely reversal points a1, a2, and a3, pair 2 (i.e. wires 3-6) comprises one (1) reversal point 120, namely reversal point b1, pair 1 (i.e. wires 4-5) comprises one (1) reversal point 120, namely reversal point c1, and pair 4 (i.e. wires 7-8) comprises three (3) reversal points as in 120, namely reversal points d1, d2, and d3. Also, the reversal points b0, b0', c0, and c0' provided in trace halves (references 110 and 112 in FIG. 9) are illustratively not part of the transmission line 114 but rather implemented as part of the compensation described herein above with reference to FIGS. 10 and 11 for the pair combination 1-2 (i.e. wires 4-5 and 3-6).

Still referring to FIGS. 13A and 13B, on a parallel transported signal, compensation in both DM CM may be introduced by crossing the conductive traces (reference 108 in FIG. 9). In this case, it is desirable to maintain the same distance between the crossing areas in order to improve compensation of CM and DM signals. In particular, for two conductor pairs, one crossing of the traces 108 of the second pair may be introduced between two (2) consecutive crossings of the traces 108 of the first pair in order to compensate for crosstalk according to a first embodiment of the present invention. Alternatively, according to a second embodiment of the present invention, one crossing of the traces 108 of the second pair may be introduced at the second of three (3) consecutive crossings of the traces 108 of the first pair.

Referring back to FIG. 2 in addition to FIGS. 13A and 13B, in a minimum configuration, sections $\mathbf{118}_1$ and $\mathbf{118}_6$ of the trace halves 110 and 112 could be joined together, thereby eliminating the need for sections $\mathbf{118}_2$, $\mathbf{118}_3$, $\mathbf{118}_4$, and $\mathbf{118}_5$. As a result, there is provided flexibility to extend the transmission line 114 to include as many sections as in 118 as required to span a physical distance between the plug receiving openings as in 18, as desired for a given connector design. The flex PCB 70 (and accordingly the terminal support structure 64) may further by designed such that an angle between the line of plug insertion X drawn through the plug receiving opening 18 of housing member 26 is angled between 0 and 360 degrees from the line of plug insertion Y drawn through the plug receiving opening 18 of housing member 28. Indeed, although the lines X and Y are shown for illustrative purposes as being collinear (see FIG. 2), i.e. the connector 10 is inline, it will be understood that lines X and Y may intersect, e.g. at right angles, such that the plug receiving openings as in 18 are angled relative to one another, thus enabling front-to-side configuration (instead of back-to-back). Alternatively, a Flame-Retardant 4 (FR4) PCB with copper covering may be used to connect the two (2) halves 110 and 112, thereby enabling for a front-to-front configuration (instead of back-to-back), in which the flex PCB 70 does a U-turn such that both plug receiving openings as in 18 are provided on the same end of the connector, illustratively the front end (reference 14 in FIG. 1). In this manner, the connector 10 may be provided with plug receiving openings as in 18 and accordingly lines of plug insertion X and Y, which are angled relative to one another so as to facilitate coupling of cables (reference 22 in FIG. 1) and thus make the connector design of the present invention advantageously adaptable to any desired configuration.

Still referring to FIGS. 13A and 13B, a plurality of regions, illustratively three (3), $\mathbf{122}_i$, $\mathbf{122}_{ii}$, and $\mathbf{122}_{iii}$, may further be defined which correspond to adjacent sections $\mathbf{118}_1$ and $\mathbf{118}_2$, adjacent sections $\mathbf{118}_3$ and $\mathbf{118}_4$, and adjacent sections $\mathbf{118}_5$ and $\mathbf{118}_6$ provided between adjacent connectors as in $\mathbf{10}_1$, $\mathbf{10}_2$, $\mathbf{10}_3$. The design of the transmission line 114 is such that each section as in 118 comprises at least one (1) reversal point 120, as discussed herein above, while each region $\mathbf{122}_i$, $\mathbf{122}_{ii}$, and $\mathbf{122}_{iii}$, comprises at least two (2) reversal points as in 120 between any adjacent pairs of traces (reference 108 in FIG. 9). In order to increase the design's flexibility, the distance (not shown) between the reversal points as in 120 may further be varied from one pair of traces as in 108 to another.

Still referring to FIGS. 13A and 13B, the reversal points as in 120 advantageously enable mapping of the polarity of the signal from the position of the plug (reference 20 in FIG. 1) at one end of the connector (reference 10 in FIG. 1) to the corresponding position of the plug 20 at the opposite end. The reversal points as in 120 further allow to substantially cancel out electromagnetic coupling, such as alien crosstalk, between a first conductor pair of a first connector $\mathbf{10}_1$ and a second conductor pair of a second adjacent connector $\mathbf{10}_2$ within regions $\mathbf{122}_i$, $\mathbf{122}_{ii}$, and $\mathbf{122}_{iii}$. For example, in region $\mathbf{122}_i$, pair 4 (wires 7-8) from the first connector $\mathbf{10}_1$ and pair 3 (wires 1-2) from the second connector $\mathbf{10}_2$ have two (2) reversal points as in 120 in sections $\mathbf{118}_1$ and $\mathbf{118}_2$, namely reversal points d1 and a3 respectively. In addition, the reversal points as in 120 cancel out crosstalk between adjacent conductor pairs within a given connector $\mathbf{10}_1$, $\mathbf{10}_2$, or $\mathbf{10}_3$. This is achieved by locating the reversal points as in 120 at specific locations along the transmission line 114. For example, for region $\mathbf{122}_{ii}$ of connector $\mathbf{10}_1$, pair combinations 3-6/1-2, 1-2/7-8, and 7-8/4-5 comprise two (2) reversal points as in 120 located in sections $\mathbf{118}_3$ and $\mathbf{118}_4$, respectively reversal points b1 and a2, d2 and a2, and d2 and c1.

Figure 14A:
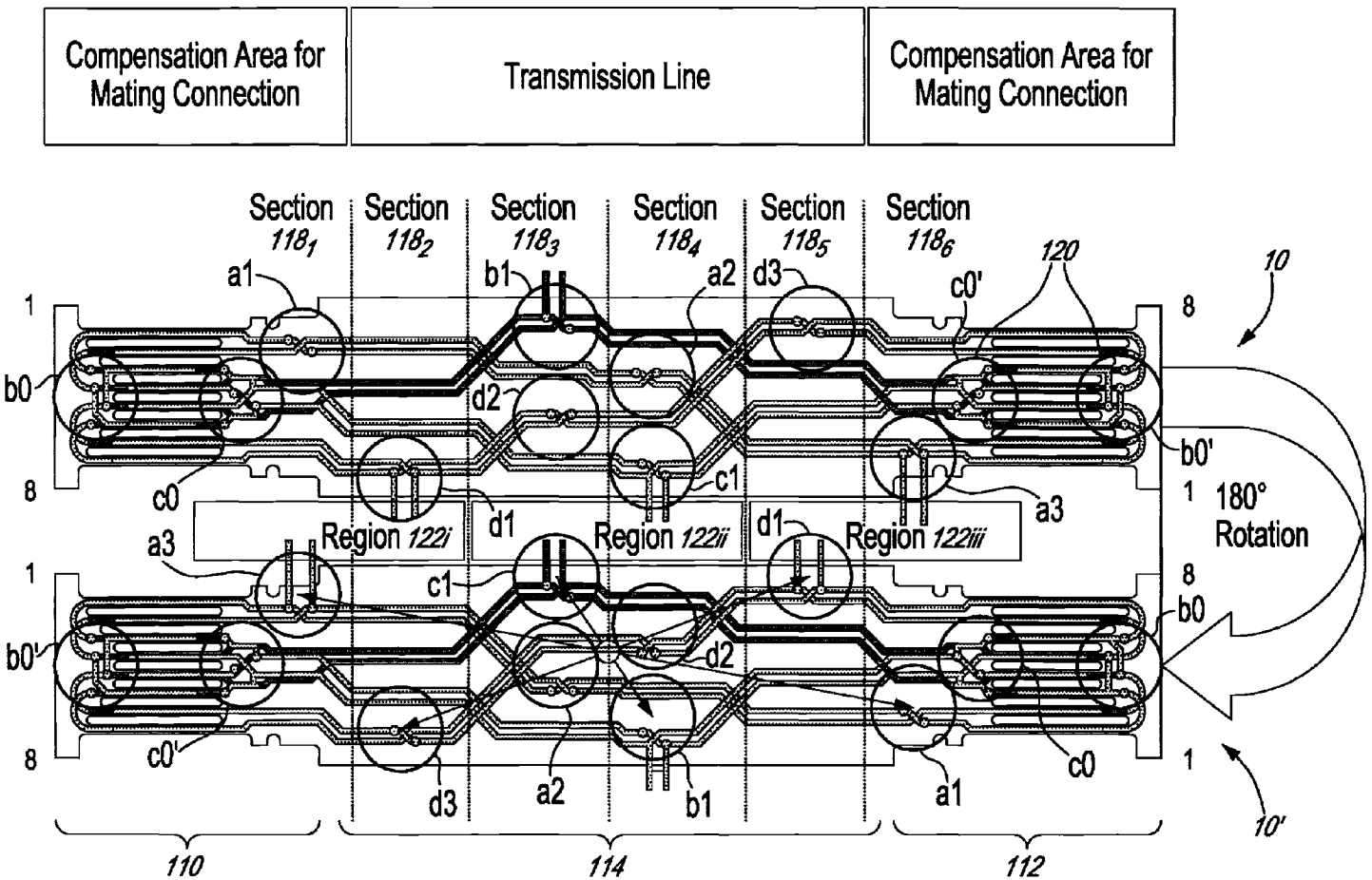
FIGS. 14A and 14B together provide a schematic diagram of the transmission line network of FIGS. 13A and 13B for a rotated coupler connector.
Figure 14B:
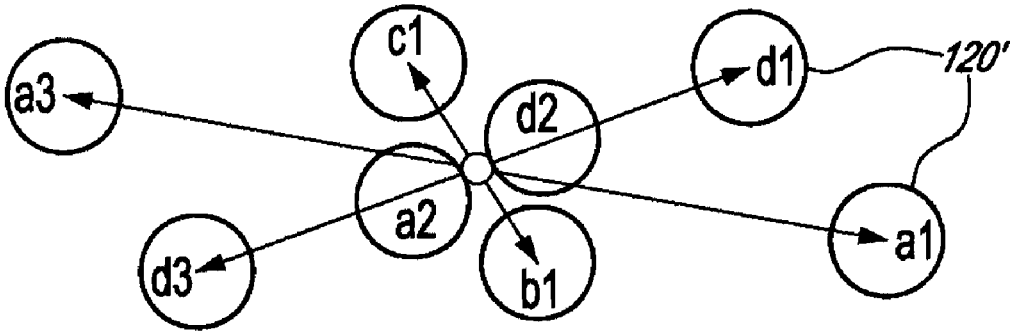

Referring now to FIGS. 14A and 14B, the design of the connector 10 and in particular the predefined location of the reversal points as in 120 is such that even if the connector 10 is rotated by 180 degrees around a center point (not shown) thereof, the reversal points as in 120' of the rotated connector 10' advantageously occupy the same physical location in space as the initial reversal points as in 120 of the non-rotated connector 10. As a result, the connector 10 can advantageously be flipped over or otherwise rotated without affecting the electromagnetic coupling between pairs of adjacent connectors (references $\mathbf{10}_1$, $\mathbf{10}_2$, or $\mathbf{10}_3$ in FIGS. 13A and 13B) as well as between adjacent trace pairs within a connector 10.

Referring back to FIG. 1, as discussed herein above, the connector 10 of the present invention advantageously provides maximum design flexibility and reduces the complexity of pre-terminated cabling solutions by simplifying installation. Overall, the connector 10 allows for fast and efficient installation of cabling systems, thus improving the reliability of the assembly by maximizing performance.

Although the present invention has been described hereinabove by way of specific embodiments thereof, it can be modified, without departing from the spirit and nature of the subject invention as defined in the appended claims.

We claim:

1. A coupler connector for coupling a first cable and a second cable in electrically conducting relation to each other, the first cable and the second cable respectively terminated by a first modular plug and a second modular plug each comprising respectively a first plurality of contact terminals and a second plurality of contact terminals, the connector comprising:

a terminal assembly comprising a flexible printed circuit board, said flexible printed circuit board comprising a first plurality of contact elements provided at a first end of said flexible printed circuit board, each of said first plurality of contact elements electrically interconnected with a respective one of a second plurality of contact elements provided at a second end of said flexible printed circuit board;

a first plug-receiving opening adapted to receive the first modular plug therein, wherein said first plurality of contact elements is disposed within said first plug-receiving opening such that when the first cable is inserted into said first opening, each of the first plurality of contact terminals comes into contact with a respective one of said first plurality of contact elements and a second plug-receiving opening adapted to receive the second modular plug therein, wherein said second plurality of contact elements is disposed within said second plug-receiving opening such that when the second cable is inserted into said second opening, each of the second plurality of contact terminals comes into contact with a respective one of said second plurality of contact elements.

2. The coupler connector of claim 1, further comprising a housing, wherein said first-plug receiving opening and said second-plug receiving opening are moulded within said housing.

3. The coupler connector of claim 2, wherein said first-plug receiving opening and said second-plug receiving opening are positioned relative to one another such that a direction of insertion of the modular plug into said first-plug receiving opening is at right angles to a direction of insertion of said second modular plug into said second-plug receiving opening.

4. The coupler connector of claim 2, wherein said first-plug receiving opening and said second-plug receiving opening are positioned side by side such that a direction of insertion of the modular plug into said first-plug receiving opening is the same as a direction of insertion of said second modular plug into said second-plug receiving opening.

5. The coupler connector of claim 2, wherein said first-plug receiving opening and said second-plug receiving opening are positioned back to back such that a direction of insertion of the modular plug into said first-plug receiving opening is opposite to a direction of insertion of said second modular plug into said second-plug receiving opening.

6. The coupler connector of claim 1, wherein said flexible printed circuit board comprises at least one bend therein.

7. The coupler connector of claim 1, further comprising a cross-talk compensating network for electrically interconnecting said first plurality of contact elements with said second plurality of contact elements.

8. The coupler connector of claim 7, wherein said cross-talk compensating network comprises a plurality of conductive traces etched in both surfaces of said flexible printed circuit board.

9. A cross talk reducing network for interconnecting a first cable and a second cable in electrically conducting relation to each other, the first cable and the second cable terminated respectively by a first modular plug and a second modular plug each comprising respectively a first plurality of contact terminals and a second plurality of contact terminals, the network comprising:

at least one cross talk reducing portion, each portion comprising a first pair of conductors and a second pair of conductors arranged side by side and in parallel, all of said conductors having substantially the same length, said first pair of conductors crossing over one another substantially at half way along said length and said second pair of conductors crossing over one another substantially half way between half way along said length and each end of said second pair of conductors;

wherein said first pair of conductors and said second pair of conductors interconnect respective pairs of contact terminals of the first plug and the second plug.

10. The cross talk reducing network of claim 9, further comprising a plurality of said crosstalk reducing portions concatenated together.

11. The cross talk reducing network of claim 9, wherein said second pair of conductors further cross over one another substantially at half way along said length.

12. The cross talk reducing network of claim 9, further comprising a flexible printed circuit board, and wherein said first pair of conductors and said second pair of conductors each comprise conductive traces etched on both surfaces of said flexible printed circuit board.

13. A method for reducing cross talk when interconnecting a first cable and a second cable, the first cable and the second cable terminated respectively by a first modular plug and a second modular plug each comprising respectively a first plurality of contact terminals and a second plurality of contact terminals, the method comprising:

interconnecting a first pair of the first plurality of contact terminals with a first pair of the second plurality of contact terminals using a pair of conductors and interconnecting a second pair of the first plurality of contact terminals with a second pair of the second plurality of contact terminals using a second pair of conductors;

said first pair of conductors and said second pair of conductors arranged side by side and in parallel, all of said conductors having substantially the same length; and crossing said first pair of conductors over one another substantially at half way along said length and crossing said second pair of conductors over one another substantially half way between half way along said length and each end of said second pair of conductors.

14. The method for reducing cross talk of claim 13, further comprising crossing said second pair of conductors over one another substantially at half way along said length.

15. The method for reducing cross talk of claim 13, further comprising providing a flexible printed circuit board and etching at least one of said first pair of conductors and at least one of said second pair of conductors as conductive traces on both surfaces of said flexible printed circuit board.

16. A coupler connector for coupling a first cable and a second cable in electrically conducting relation to each other, the first cable and the second cable terminated respectively by a first modular plug and a second modular plug each comprising respectively a first plurality of contact terminals and second plurality of contact terminals, the balanced connector comprising:

a first plug-receiving receptacle adapted to receive the first modular plug therein and a second plug-receiving receptacle adapted to receive the second modular plug therein; and a terminal assembly comprising a first plurality of contact elements disposed in said first plug receiving receptacle, a second plurality of contact elements disposed in said second plug receiving receptacle and a flexible printed circuit board comprising a plurality of conductive traces, said traces interconnecting respective ones of said first plurality of contact elements and said second plurality of contact elements;

wherein when the first cable is inserted into said first receptacle each of the first plurality of contact terminals comes into contact with a respective one of said first plurality of contact elements and when the second cable is inserted into said second opening, each of the second plurality of contact terminals comes into contact with a respective one of said second plurality of contact elements.

17. The coupler connector of claim 16, further comprising a housing and wherein said first plug-receiving receptacle and said second plug-receiving receptacle are formed in said housing.

18. The coupler connector of claim 17, wherein said housing is comprised of two separate housing parts, wherein said first plug-receiving receptacle is formed in a first of said housing parts and said second plug-receiving receptacle is formed in a second of said housing parts and wherein said first housing part and said second housing part are flexible interconnected by said flexible printed circuit board.

* * * * *